US005609279A

United States Patent [19]

O'Shea

[11] Patent Number: 5,609,279

[45] Date of Patent: Mar. 11, 1997

[54] CHILD CARRIER

[75] Inventor: Timothy O'Shea, Seattle, Wash.

[73] Assignee: American Recreation Products, Inc., St. Louis, Mo.

[21] Appl. No.: 502,489

[22] Filed: Jul. 14, 1995

[51] Int. Cl.[6] ..... A61G 1/00

[52] U.S. Cl. ..... 224/160; 224/155; 224/158; 224/159; 224/161; D3/214; D3/217

[58] Field of Search ..... 224/160, 161, 224/155, 158, 159, 151, 156, 153, 224, 208, 581, 627–629, 633, 636, 637, 654, 655, 660; D3/216, 217, 214

[56] References Cited

U.S. PATENT DOCUMENTS

| | | | |
|---|---|---|---|
| 2,346,989 | 4/1944 | O'Brien | 224/161 |
| 3,840,161 | 10/1974 | Boggs et al. | 224/161 |
| 4,923,104 | 5/1990 | Rice et al. | 224/160 |

OTHER PUBLICATIONS

Photographs and "Tough Traveler" Brochure of child carrier back pack dated 1992.

*Primary Examiner*—Henry J. Recla
*Assistant Examiner*—Timothy L. Maust
*Attorney, Agent, or Firm*—Senniger, Powers, Leavitt & Roedel

[57] ABSTRACT

A child carrier for supporting a child adjacent the back of a hiker's torso comprising a forward portion, a rearward portion, a seat portion, and a hood. The forward portion has straps engageable with the hiker's torso for enabling the hiker to tote the child carrier in a hands-free manner. The rearward portion is generally rearward of and spaced from the forward portion. The seat portion is generally between the forward and rearward portions and operatively connected thereto for supporting a child. A child compartment is between the forward and rearward portions and is defined at least in part by the seat portion. The hood is of flexible sheet material and is moveable between a covering position in which the hood extends generally from the rearward portion to the forward portion to cover the child compartment and an uncovering position in which the child compartment is exposed. A cover support comprising at least one flexible resilient rib is adapted to extend from adjacent the rearward portion to adjacent the forward portion when the hood is in its covering position for supporting the hood over the child compartment.

28 Claims, 9 Drawing Sheets

20
22
24
26
28
30
32
34
36
38
40
42
44
46
48
50
52
54
60
64
66
70
72
74
80
82
84
86
100
102
108
114
116
117

CHILD CARRIER

BACKGROUND OF THE INVENTION

This invention relates generally to child carriers for supporting children adjacent the backs of hikers, and more particularly to child carriers having hoods for covering children within the carriers.

A conventional child carrier has a forward portion with shoulder straps and a waist strap (belt) for holding the child carrier on the back of a hiker. A child compartment for holding a child is generally rearward of the forward portion. Some child carriers have hoods positionable over the child compartment for shielding the child compartment from sun and/or rain.

A disadvantage of such hooded child carriers is that the hoods are often cumbersome to employ; it is difficult and time consuming to properly attach the hood to the child carrier. Another disadvantage of such child carriers is that the hoods cannot be readily stored in a pouch or pocket in the carrier. As a result, users frequently drape the hoods over the back of the carrier when not in use, or choose before hikes to leave the hoods behind. Another disadvantage is that hoods of such child carriers decrease "head-room" of the child compartment to the discomfort of the child. Moreover, such carriers do not adequately cover the child compartment and thereby allow rain to flow off the hood and into the child compartment.

SUMMARY OF THE INVENTION

Among the several objects and features of this invention may be noted the provision of an improved hooded child carrier; the provision of such a child carrier in which use of the hood is simple and easy; the provision of such a child carrier in which the hood is readily accessible when not in use without interfering with access to compartments or other portions of the child carrier; the provision of such a child carrier in which the hood does not interfere with a child's movement of his or her head within the child compartment; the provision of such a child carrier which prevents rain water from flowing off the hood and into the child compartment; and the provision of such a child carrier in which the hood is of simple construction.

Generally, a child carrier of the present invention for supporting a child adjacent the back of a hiker's torso comprises a forward portion, a rearward portion, a seat portion, and a hood. The forward portion has straps engageable with the hiker's torso for enabling the hiker to tote the child carrier in a hands-free manner. The rearward portion is generally rearward of and spaced from the forward portion. The seat portion is generally between the forward and rearward portions and operatively connected thereto for supporting a child. A child compartment is between the forward and rearward portions and is defined at least in part by the seat portion. The hood is of flexible sheet material and is moveable between a covering position in which the hood extends generally from the rearward portion to the forward portion to cover the child compartment and an uncovering position in which the child compartment is exposed. A cover support comprising at least one flexible resilient rib is adapted to extend from adjacent the rearward portion to adjacent the forward portion when the hood is in its covering position for supporting the hood over the child compartment.

In another aspect of the present invention, a child carrier includes a hood and a cover support. The hood is of flexible sheet material and is moveable between a covering position in which the hood extends generally from the rearward portion to the forward portion to cover the child compartment and an uncovering position in which the child compartment is exposed. The cover support comprises at least one flexible resilient rib adapted to extend in arched configuration over the child compartment when the hood is in its covering position for supporting the hood arched over the child compartment.

In yet another aspect of the present invention a child carrier includes a pocket in one of its rearward and forward portions and a hood. The hood is moveable between a stored position in which it is stored in the pocket and a covering position in which it extends generally from within the pocket to the other of the rearward and forward portions of the carrier to cover the child compartment.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
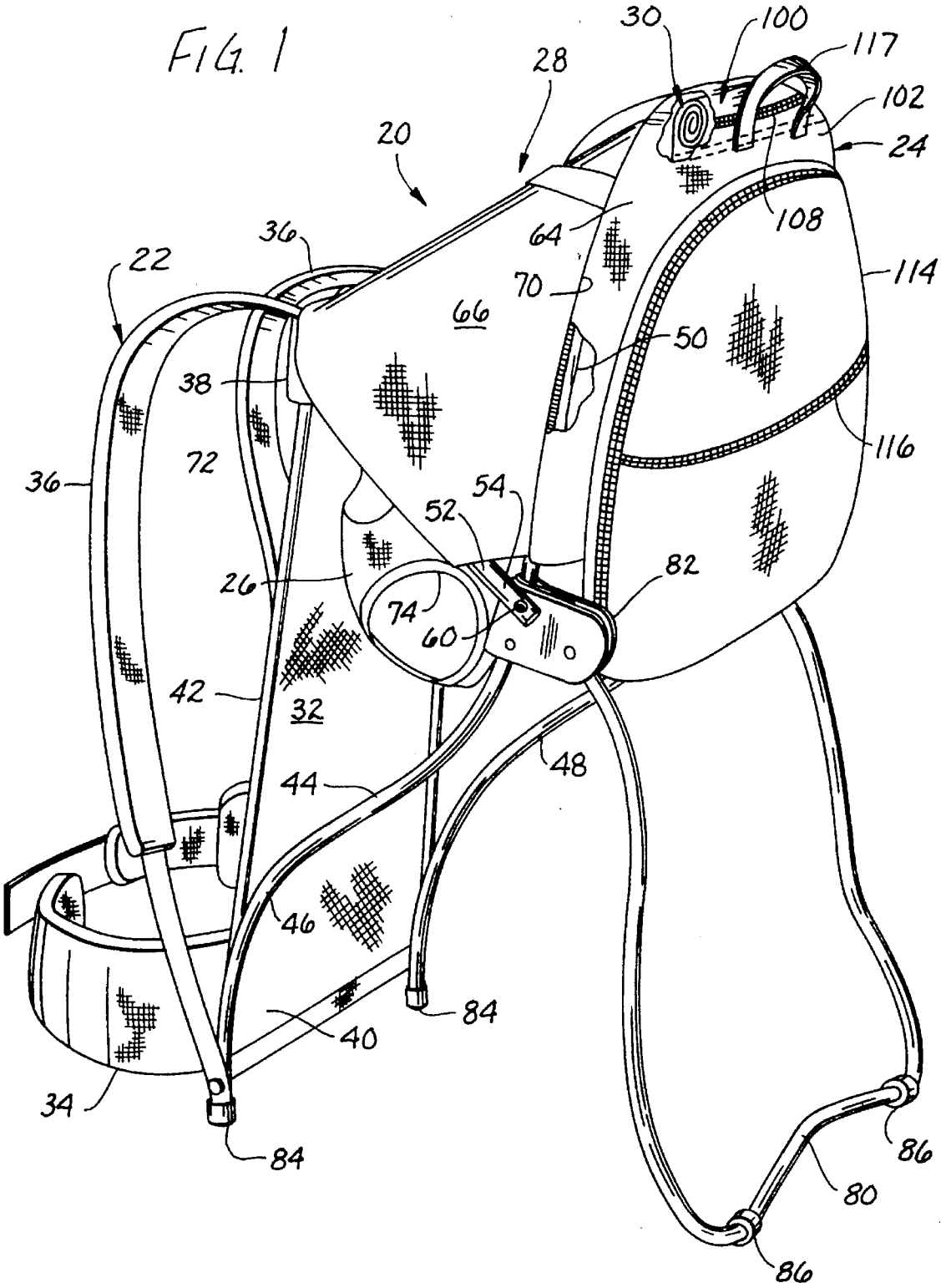
FIG. 1 is a perspective view of a child carrier of this invention with portions broken away to show a hood stored in a hood-receiving pocket.
Figure 2:
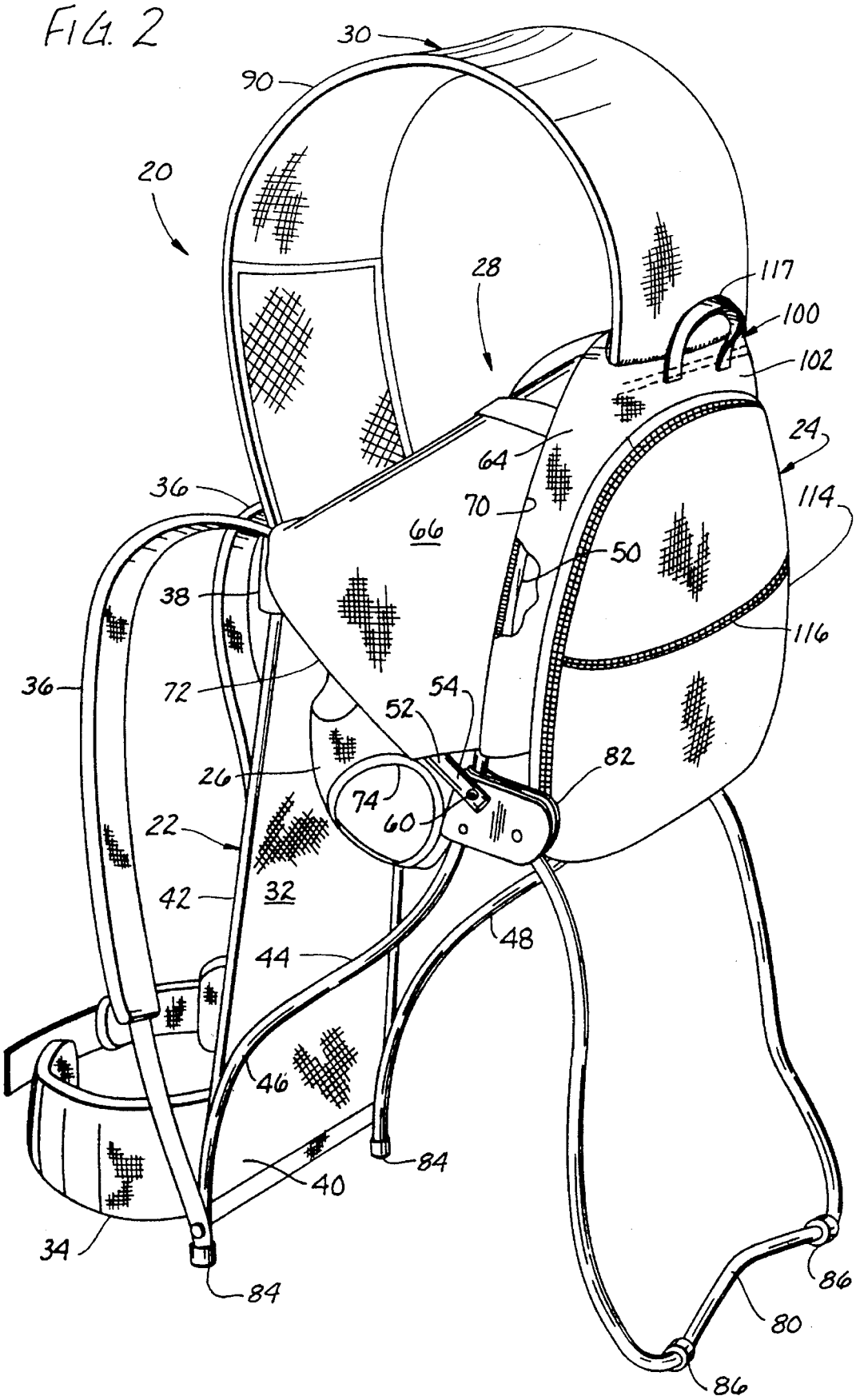
FIG. 2 is a perspective view of the child carrier of FIG. 1 with the hood extending in an arched configuration from a rearward portion of the child carrier to a forward portion thereof.
Figure 3:
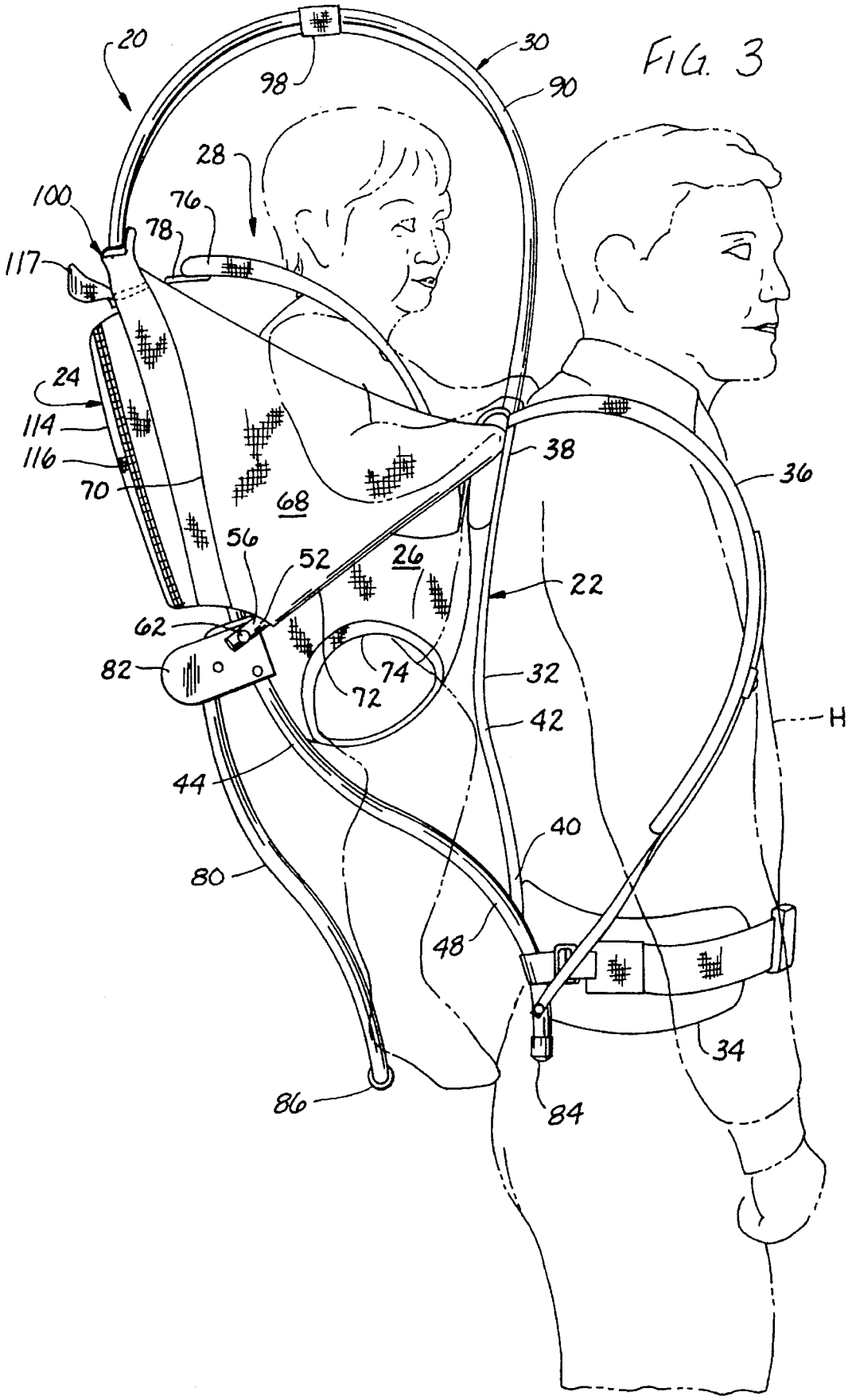
FIG. 3 is a side elevational view of the child carrier of FIGS. 1 and 2 and with a hiker and child shown in phantom.

Referring now to the drawings, and first more particularly to FIGS. 1–3, a child carrier is indicated in its entirety by the reference numeral 20. The child carrier 20 is adapted for supporting a child C (FIG. 2) adjacent the back of a hiker H. It comprises a forward portion, generally indicated at 22, a rearward portion, generally indicated at 24, a child seat portion 26, a child compartment, generally indicated at 28, between the forward and rearward portions, and a hood, generally indicated at 30, for covering the child compartment.

The forward portion 22 comprises a forward member 32, an adjustable waist strap (belt) 34, and adjustable shoulder straps 36. The forward member 32 is preferably formed of multiple sheets of flexible material joined together as by stitching and is adapted for conforming to and abutting the back of the hiker's torso. It includes an upper region 38 engageable with the upper back of a hiker H wearing the child carrier 20, a lower region 40 adjacent the lower back of the hiker, and an intermediate region extending between the upper and lower regions. The waist strap 34 is attached to the lower region 40 of the forward member 32 for engaging the waist of the hiker H. The shoulder straps 36 are secured to the upper region 38 of the forward member 32 for engaging the shoulders of the hiker H. Preferably, the intermediate region 42 of the forward member 32 comprises a nylon mesh material for permitting the back of the hiker H to breath. As shown in FIG. 3, the waist strap 34 and shoulder straps 36 enable the hiker H to tote the child carrier 20 in a hands-free manner.

A main frame member 44, having an inverted-U shaped comprises left and right leg portions 46, 48 and a curved central portion 50 adjacent a rear of the child compartment 28. The left and right leg portions 46, 48 are connected adjacent their lower ends to the waist belt 34 and extend upward and rearward (i.e., to the left as viewed in FIG. 3) to the central portion 50 of the main frame member 44. A U-shaped bracket 52, having left and right side portions 54, 56 and a generally horizontal intermediate portion 58 (FIG. 4), connects the main frame member 44 to the upper region 40 of the forward member 32. The left and right side portions 54, 56 of the bracket 52 are pivotally connected at 60 and 62 to upper regions of the leg portions 46, 48 of the main frame member 44 and extend upward and forward therefrom along sides of the child compartment 28. The intermediate portion 58 of the bracket 52 extends laterally through and is secured to the upper region 38 of the forward member 32.

A flexible, back-support pouch 64, having an open bottom, is positioned over the curved central portion 50 of the main frame member 44. The curved central portion 50 of the main frame member 44 maintains the back-support pouch 64 in a taut configuration for supporting the back of the child C seated in the child compartment 28. The back-support pouch 64 and the curved central portion 50 of the main frame member 44 comprise the rearward portion 24 of the child carrier. Left and right side panels 66, 68 of generally triangular-shape have rear edge margins 70 attached to opposite sides of the back-support pouch 64, and bottom edge margins 72 attached to the side portions 56, 58 of the bracket 52. The back-support pouch 64 and bracket 52 hold the side panels 66, 68 taut. The child seat portion 26 is attached to and depends from a bottom edge margin (not shown) of the back support pouch 64 and the bottom edge margins 72 of the side panels 66, 68. The child seat portion 26 has leg holes 74 for passage therethrough of the child's legs. The back-support pouch 64, side panels 66, 68, and child seat portion 26 define the child compartment 28. A conventional child safety harness 76, having a rear end 78 (left end as viewed in FIG. 3) stitched to the back-support pouch 64 and a forward end (not shown) releasably connectable via a conventional safety buckle (not shown) to a forward part of the seat portion 26, maintains the child C in the child compartment 28. Preferably, the back-support pouch 64, side panels 66, 68, and seat portion 26 are of a suitable lightweight, flexible material such as a nylon material. It is to be understood that the back-support pouch 64, side panels 66, 68, and seat portion 26 may be formed of a single unitary sheet of material but are preferably formed from multiple sheets of material joined together as by stitching.

Preferably, a kickstand 80 is pivotally connected to the main frame member via suitable hinges 82. When the child carrier is not being worn by the hiker H, then the kickstand 80 may be pivoted rearwardly (i.e., to the left as viewed in FIG. 2) so that the kickstand and main frame member 44 may support the child carrier 20 in an upright manner (see FIG. 1). Preferably, front feet 84 are positioned on lower ends of the leg portions 46, 48, and rear feet 86 are positioned on the kickstand 80 for engagement with a generally horizontal surface, such as a floor or ground.

Figure 4:
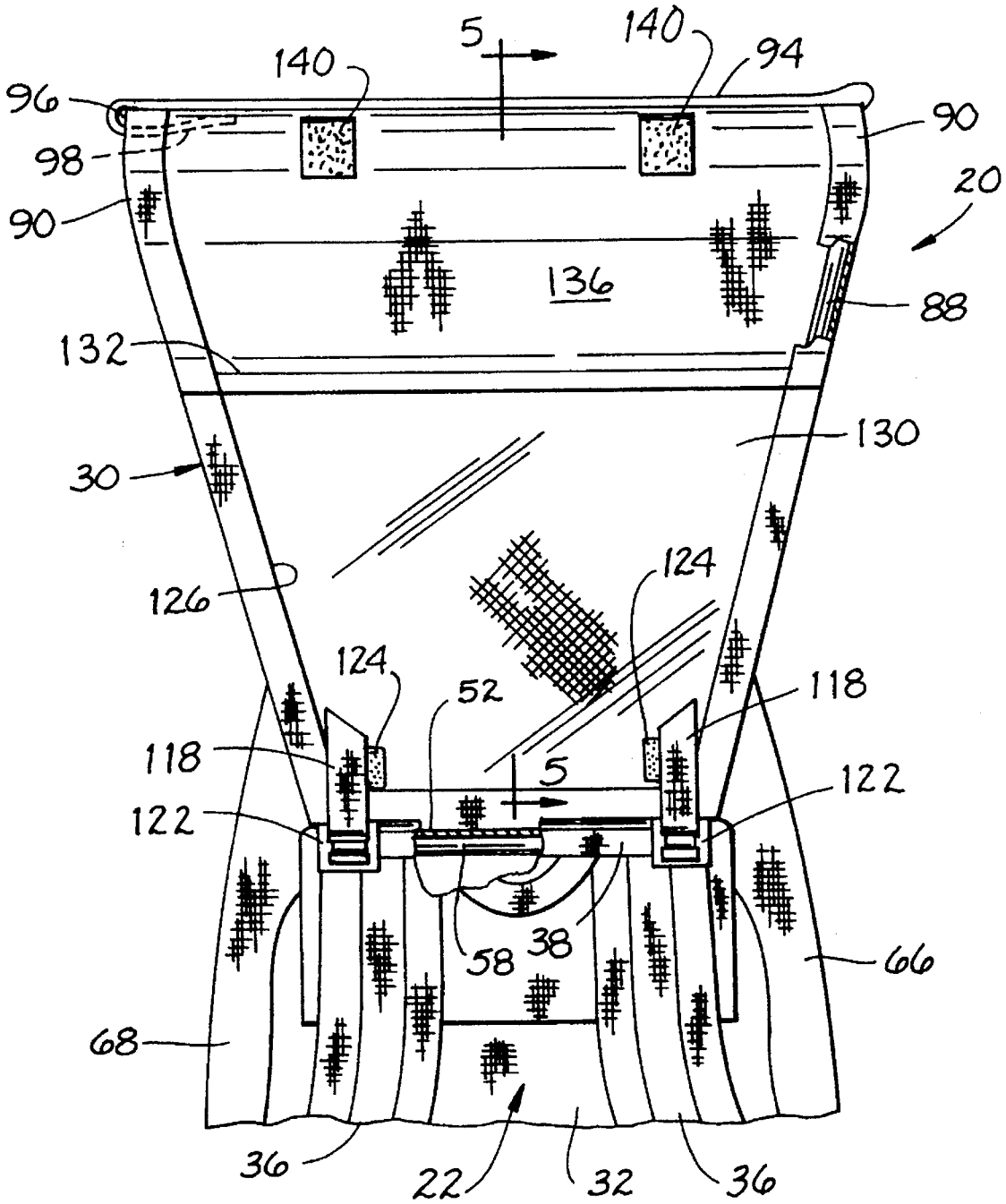
FIG. 4 is a fragmented front elevational view of the child carrier of FIGS. 1–3 with portions broken away to show detail.
Figure 5:
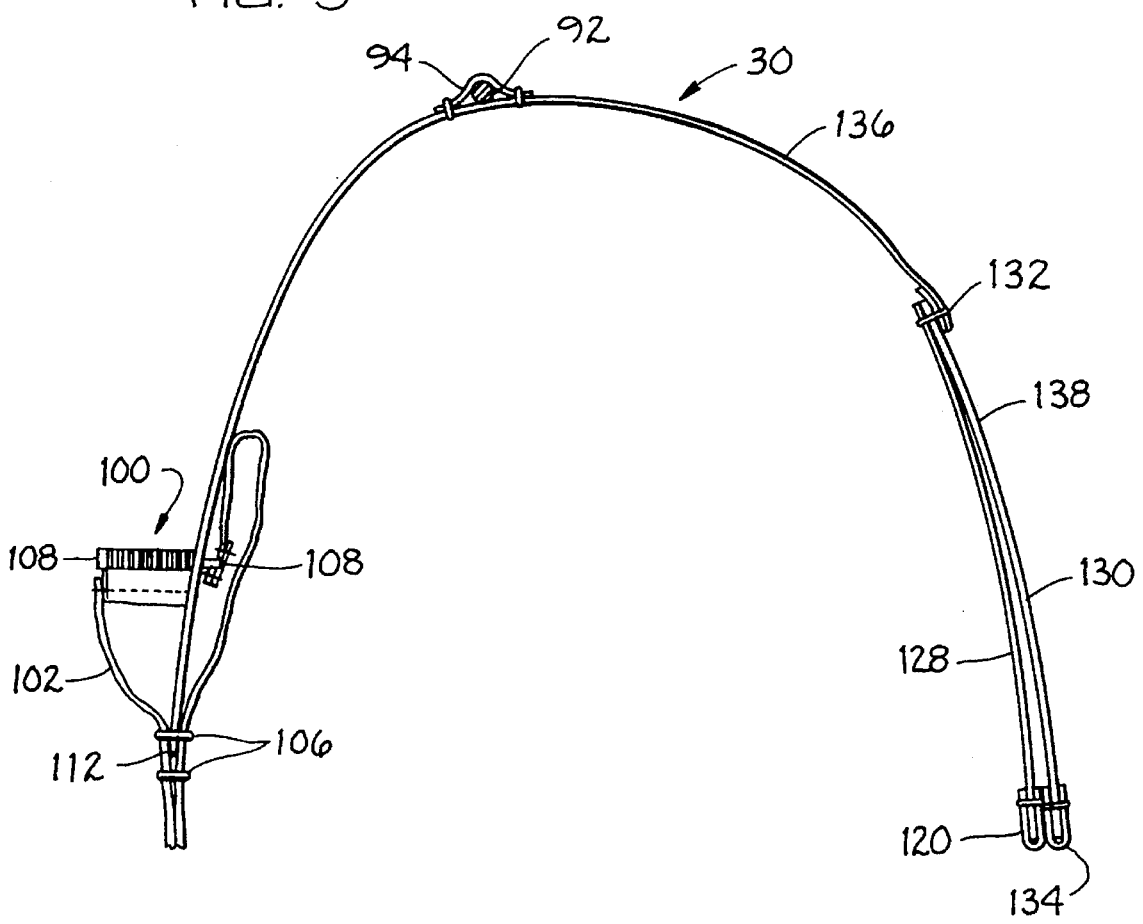
FIG. 5 is a cross-sectional view taken along the plane of line 5—5 of FIG. 4.
Figure 6:
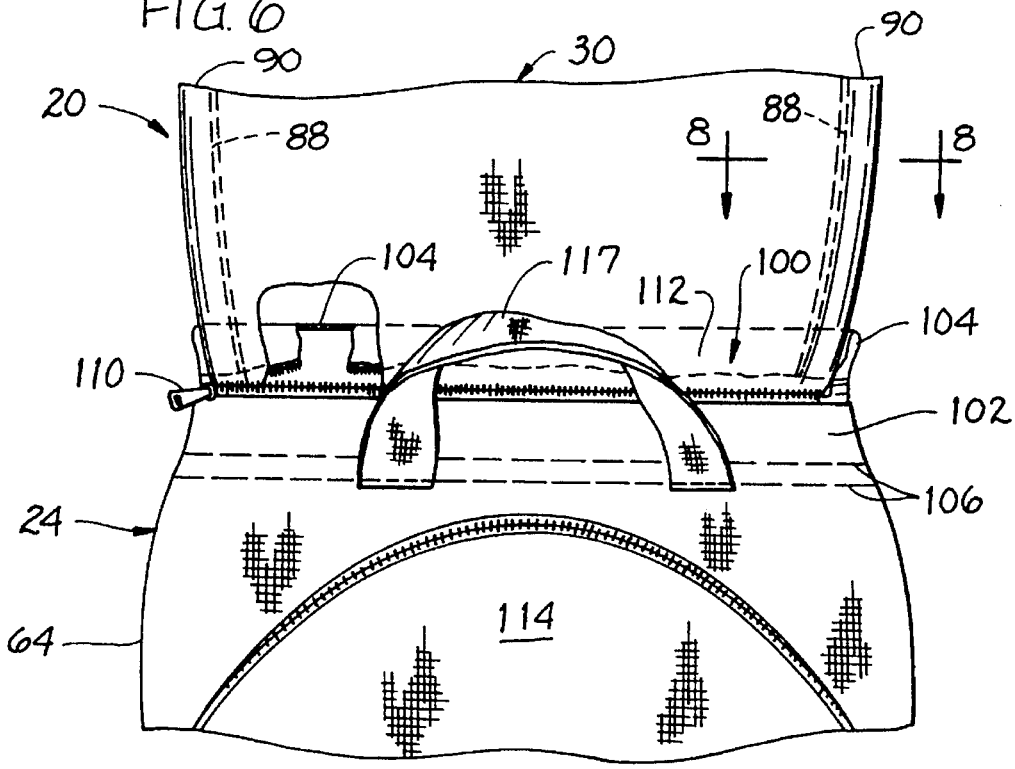
FIG. 6 is a fragmented rear elevational view of the child carrier of FIGS. 1–3 showing the hood extending from the hood-receiving pocket in the rear portion of the child carrier.
Figure 7:
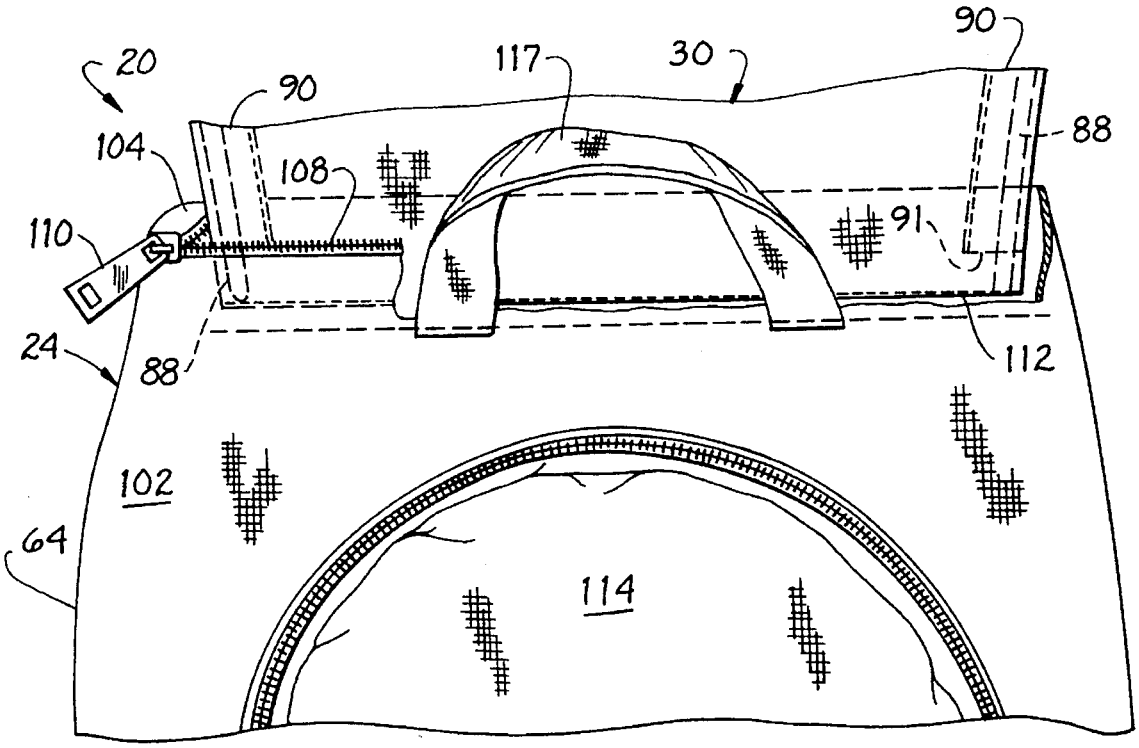
FIG. 7 is an enlarged fragmented rear elevational view similar to the view of FIG. 6 with portions broken away to show detail.
Figure 8:
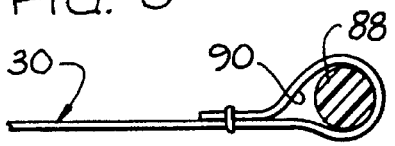
FIG. 8 is cross-sectional view taken along the plane of line 8—8 of FIG. 3.

Referring to FIGS. 4 and 5, the hood 30 is preferably formed of multiple panels of flexible, water-impermeable, nylon sheet material and is moveable between an uncovering position (e.g., FIG. 1) in which the child compartment 28 is exposed and a covering position (FIGS. 2–4) in which the hood extends from the back-support pouch 64 to the upper region 38 of the forward member 32 to cover the child compartment. First and second flexible resilient ribs 88 (side ribs) extend in arched configuration over the child compartment 28 from adjacent the back-support pouch 64 (FIGS. 6 and 7) to adjacent the upper region 38 of the forward member 32 when the hood 30 is in its covering position for supporting the hood arched over the child compartment. The side ribs 88 extend through first and second elongate sleeves 90 (FIGS. 4 and 8) along opposite side edge margins of the hood 30. Preferably the sleeves 90 extend substantially the full length of the hood 30. Also preferably, the sleeves 90 have open rearward ends 91 (FIG. 7) adjacent the back-support pouch 64 for insertion of the ribs into and removal of the ribs from the sleeves 90. A third flexible resilient rib 92 (transverse rib) is received in a third sleeve 94 (FIGS. 4 and 5) extending laterally with respect to the hood 30 between the first and second sleeves 90. The transverse rib 92 maintains a constant spacing between the side ribs 88 to prevent sagging of the hood 30 into the child compartment 28. Preferably, the third sleeve 94 has an open end 96 (e.g., the left end as viewed in FIG. 4) for insertion of the transverse rib 92 into and removal of the transverse rib from the sleeve. A flexible closure tab 98 is releasably secured to the third sleeve via mateable hook- and loop-type fasteners for closing the open end 96 of the third sleeve to maintain the transverse rib 92 in the third sleeve. The side ribs 88 and the transverse rib 92 constitute a cover support for maintaining the hood 30 in a taut configuration over the child compartment 28.

Figure 9:
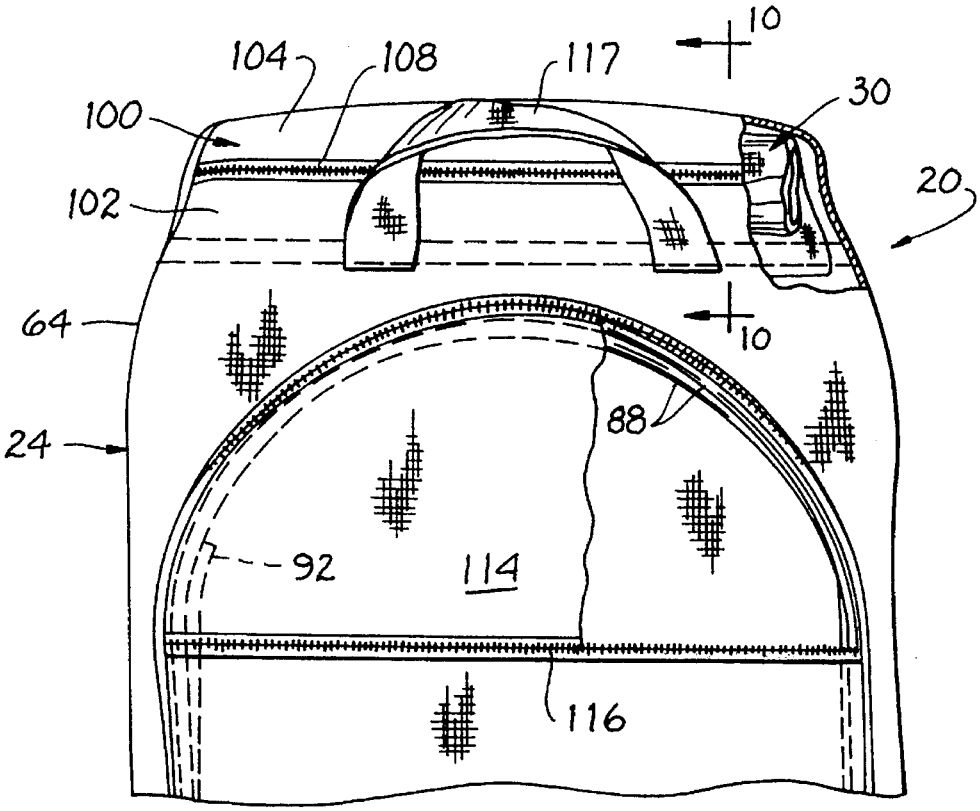
FIG. 9 is a fragmented rear elevational view of the child carrier of FIGS. 1–3 with portions broken away to show the hood stored in the hood-receiving pocket and to show flexible ribs of a cover support stored within a storage pocket.

Referring to FIGS. 5–7, 9 and 10, a hood-receiving pocket, generally indicated at 100, is in the back-support pouch 64 of the child carrier 20 for receiving the hood 30 to store it. The hood-receiving pocket 100 comprises rearward and forward panels 102, 104 (FIG. 5) of the back-support pouch 64 stitched together along parallel seams 106. A zipper closure 108 is attached to adjacent edge margins of the rearward and forward panels 102, 104 and is opened and closed via a slide 110. Preferably, a rear edge margin of the hood 30 is stitched at seams 106 between the rearward and forward panels 102, 104. When the hood 30 is in its covering position (FIGS. 2 and 7), it extends generally from within the hood-receiving pocket 100 to the upper region 38 of the forward member 32. When the hood 30 is in its uncovering position, and more particularly when in its stored position (FIGS. 1, 9 and 10), the hood is rolled into and contained by the hood-receiving pocket 100. A rear storage pocket 114 is attached to the rearward panel 102 of the back-support pouch 64. The inside of the storage pocket 114 is accessible via a zipper closure 116 of the storage pocket. As shown in FIG. 9, when the hood 30 is stored in the hood-receiving pocket 100, the side ribs 88 and transverse rib 92 may be stored in the rear storage pocket 114. Preferably, a flexible handle 117 is secured to the rearward panel 102 of the back-support pouch 64 for enabling a user to lift the child carrier 20.

Referring to FIG. 4, two flexible hood securement tabs 118 are attached to and extend from a forward edge margin 120 (FIG. 11) of the hood 30. The tabs 118 are sized for being threaded through buckles 122 attached to the upper region 38 the forward member 32. Hook-type fasteners (not shown) on the tabs 118 are adapted to mate with loop-type fasteners 124 on the hood 30. When the hood 30 is in its covering position, the tabs 118 are looped through the buckles 122 and folded down onto the hood so that the hook-type fasteners of the tabs engage the loop-type fasteners 124 to releasably secure the forward edge margin 120 of the hood to the forward portion 22 of the child carrier 20.

Figure 11:
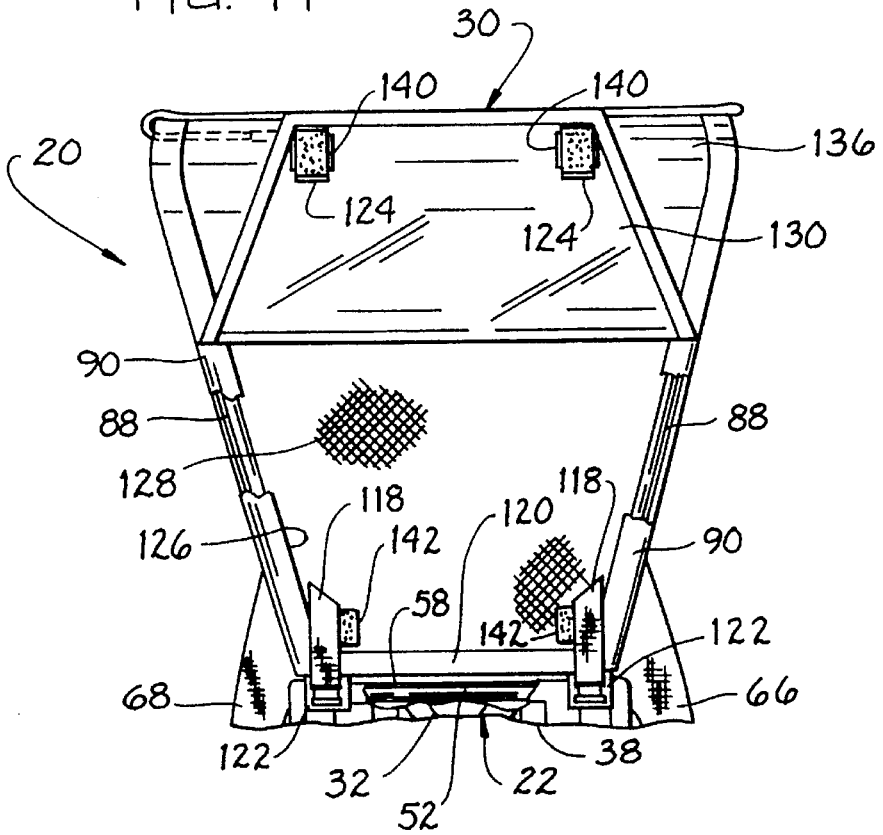
FIG. 11 is a fragmented front elevational view similar to FIG. 4 but with a transparent flap swung up and away from a window opening of the hood.
Figure 10:
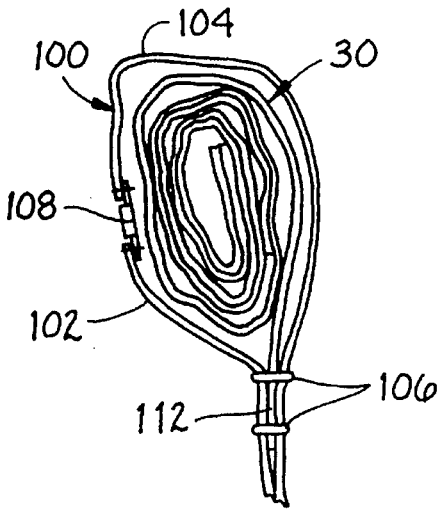
FIG. 10 is a cross-sectional view taken along the plane of line 10—10 of FIG. 9.

Referring to FIGS. 4, 5 and 11, the hood 30 further comprises a window opening 126 therein and a flexible mesh material (i.e., a sun screen 128 (FIG. 11)) in the window opening for protecting the child C within the child compartment 28 from exposure to sunlight while permitting air flow and visibility through the window opening. A generally transparent, water-impermeable, flexible flap 130 is attached to the hood 30 via a generally horizontal seam 132 (FIG. 4). The flap 130 is swingable between a closed position (FIGS. 4 and 5) and an open position (FIG. 11). In the closed position, the flap 130 covers the window opening 126 to prevent passage of rain water through the window opening. Preferably, a forward edge margin 134 of the flap 130 is closely adjacent the upper region 38 of the forward member 32 when the flap is in its closed position for preventing passage of rain between the hood 30 and forward portion 22 of the child carrier 20. In the open position (FIG. 11), the flap 130 overlies an upper panel 136 of the hood 30 and the forward edge margin 134 of the flap is adjacent the third sleeve 94. Thus, in the open position, the flap 130 is positioned away from the window opening 126.

The loop-type fasteners 124 generally discussed above are secured to the outer surface 138 of the flap 130 adjacent the forward edge margin 134 of the flap. When the flap 130 is in its closed position (FIG. 4), the hook-type fasteners on the hood securement tabs 118 engage the loop-type fasteners 124 to releasably secure the hood 30 to the forward portion 22 of the child carrier 20. Two more hook-type fasteners 140 are attached to the upper panel 136 of the hood 30 for engaging loop-type fasteners 124 of the flap when the flap is in its open position. As shown in FIG. 11, two additional loop-type fasteners 142 are on the outer surface of the sun screen 128 for releasable attachment to the hook-type fasteners of the hood securement tabs 118 when the hood 30 is in its open position to secure the hood to the forward portion 22 of the child carrier 20. To move the flap 130 from its closed position to its open position, the hood securement tabs 118 are pulled forward and away from the loop-type fasteners 124 of the flap. The flap 130 is then swung upward to its open position and the loop-type fasteners 124 of the flap mate with the hook-type fasteners 140 on the upper panel 136 of the hood 30 to hold the flap in its open position. The hood securement tabs 118 are then pulled rearward to a position in which the fasteners of the tabs mate with the fasteners 142 of the sun screen 128 to releasably secure the hood 30 to the forward portion 22 of the child carrier 20.

In use, to move the hood 30 from its stored position (FIG. 1) to its covering position (FIGS. 2 and 3), the zipper closure 108 is opened and the hood is pulled out of the hood-receiving pocket 100. The side ribs 88 and transverse rib 92 are then removed from the rear storage pocket 114 and slid into the corresponding sleeves 90, 94 of the hood 30 via the open ends 91, 96 of the sleeves. The hood securement tabs 118 extending from the forward edge margin 120 of the hood 30 are then fed through the buckles 122 on the upper region 38 of the forward member 32. The hook-type fasteners on the tabs 118 mate either with fasteners 124 on the flap 130 or with fasteners 142 on the sunscreen 128 to secure the forward edge margin 120 of the hood 30 to the forward portion 22 of the child carrier 20. Because of the arched configuration of the hood 30 in its covering position, the hood provides ample room above the child compartment 28 so that it does not interfere with a child's movement of his or her head within the child compartment. To move the hood 30 back to its stored position, the foregoing steps are reversed. Thus, movement of the hood 30 between its stored and covering positions is simple and easy.

Figure 12:
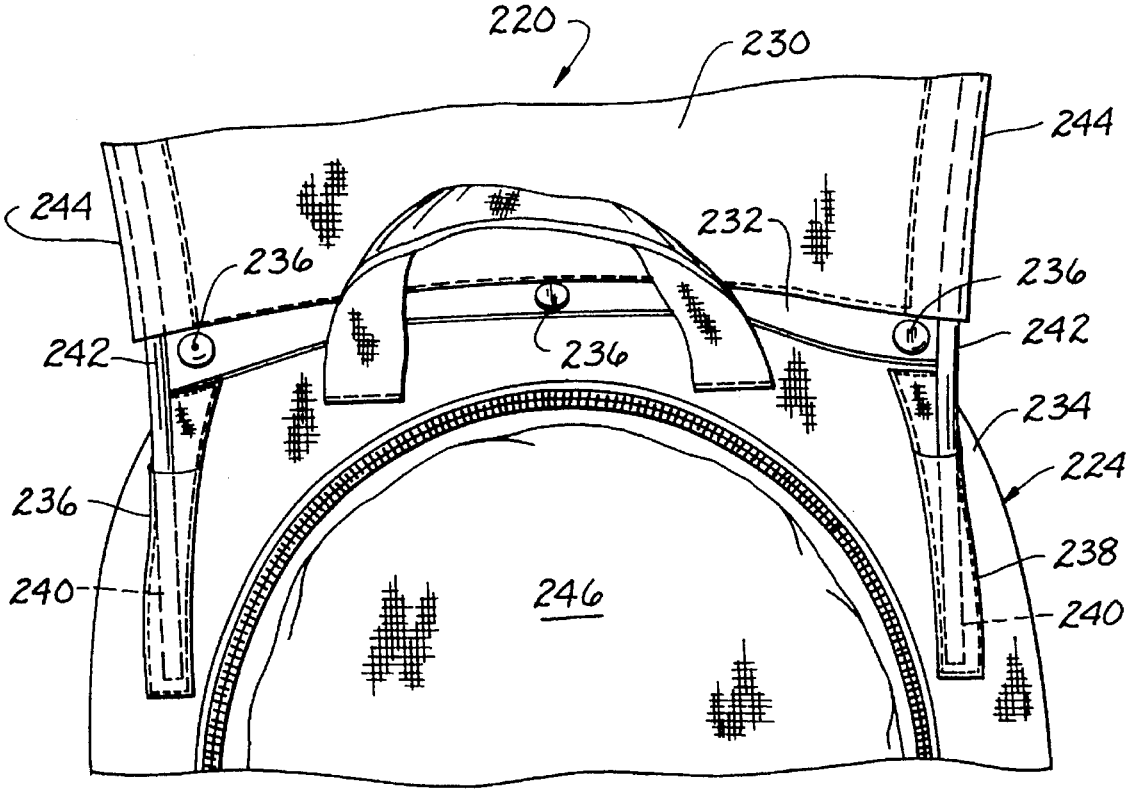
FIG. 12 is a fragmented rear elevational view of another child carrier of the present invention showing a hood attached via snaps to a rear portion of the child carrier.

Referring now to FIG. 12, another child carrier of the present invention is indicated generally at 220. The child carrier 220 has a hood 230 for covering a child compartment (not shown). The child carrier 220 is identical to the child carrier 20 of FIGS. 1–11 except for attachment of the hood 230 to a rearward portion 224 of the child carrier. A rear edge margin 232 of the hood 230 is releasably attached to a rear panel 234 of the rearward portion 224 of the child carrier 220 via suitable snap connectors 236. Although the snap connectors 236 are the preferred means for releasably attaching the hood 230 to the rear panel 234, it is to be understood that the hood could alternatively be releasably attached to the rear panel by a conventional zipper. Two rib-receiving pockets 238 are stitched or otherwise secured to the rear panel 234 for receiving end portions 240 of first and second side ribs 242. The ribs and hood comprise a canopy for covering the child compartment.

To store the canopy, the hood 230 is detached from the rearward portion 224 and forward portion (not shown) of the child carrier 220 and the ribs 242 are removed from the rib-receiving pockets 238. The ribs 242 are then removed from sleeves 244 of the hood 230. The hood 230 is then folded and placed along with the ribs 242 into a rear storage pocket 246 similar to the storage pocket 114 of the child carrier 20. Thus, the hood 230 may easily and quickly be moved between covering and storage positions.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a hood of flexible sheet material moveable between a covering position in which the hood extends generally from the rearward portion to the forward portion to cover the child compartment and an uncovering position in which the child compartment is exposed; and a cover support comprising at least one flexible resilient rib adapted to extend up from adjacent the rearward portion, over the child compartment and down to adjacent the forward portion when the hood is in its covering position for supporting the hood over the child compartment.

2. A child carrier as set forth in claim 1 wherein said rib constitutes a first flexible resilient rib and wherein said cover support further comprises a second flexible resilient rib, said first and second ribs being adapted to extend generally along opposite side edge margins of the hood from adjacent the rearward portion to adjacent the forward portion when the hood is in its covering position for supporting the hood over the child compartment.

3. A child carrier as set forth in claim 1 further comprising a storage pocket for receiving the rib.

4. A child carrier as set forth in claim 2 wherein said cover support further comprises a third flexible resilient rib adapted to extend laterally with respect to the hood between the first and second ribs for further supporting the hood when the hood is in its covering position.

5. A child carrier as set forth in claim 2 wherein said first and second ribs extend in arched configuration over the child compartment when the hood is in its covering position.

6. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a hood of flexible sheet material moveable between a covering position in which the hood extends generally from the rearward portion to the forward portion to cover the child compartment and an uncovering position in which the child compartment is exposed; and a cover support comprising at least one flexible resilient rib adapted to extend in arched configuration over the child compartment when the hood is in its covering position for supporting the hood arched over the child compartment.

7. A child carrier as set forth in claim 6 wherein the rib constitutes a first flexible resilient rib and wherein said cover support further comprises a second flexible resilient rib, the first and second ribs being adapted to extend generally along opposite side edge margins of the hood when the hood is in its covering position for supporting the hood over the child compartment.

8. A child carrier as set forth in claim 6 further comprising a window opening in the hood and a flexible mesh material covering the window opening for protecting a child within the child compartment from exposure to sunlight while permitting air flow through the window opening.

9. A child carrier as set forth in claim 7 wherein the hood further comprises first and second sleeves at the opposite side edge margins of the hood for receiving the first and second ribs.

10. A child carrier as set forth in claim 7 wherein said cover support further comprises a third flexible resilient rib adapted to extend laterally with respect to the hood between the first and second ribs for further supporting the hood when the hood is in its covering position.

11. A child carrier as set forth in claim 7 further comprising a hood-receiving pocket in the rearward portion of the carrier for receiving the hood to store its the hood, when in its covering position, extending generally from the hood-receiving pocket to the forward portion of the carrier.

12. A child carrier as set forth in claim 9 wherein said first and second sleeves are each open at one end thereof for insertion of the ribs into and removal of the ribs from the sleeves.

13. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a pocket in one of the rearward and forward portions;

a hood of flexible sheet material moveable between a stored position in which the hood is stored in the pocket and a covering position in which the hood extends generally from within the pocket to the other of said rearward and forward portions of the carrier to cover the child compartment.

14. A child carrier as set forth in claim 13 further comprising a window opening in the hood and a flexible mesh material covering the window opening for protecting a child within the child compartment from exposure to sunlight while permitting air flow through the window opening.

15. A child carrier as set forth in claim 13 further comprising a cover support having at least one flexible resilient rib for supporting the hood over the child compartment when the hood is in its covering position.

16. A child carrier as set forth in claim 14 further comprising a generally transparent, water-impermeable, flexible flap on the hood swingable between a closed position in which the flap covers the window opening to prevent passage of rain water through the window opening and an open position in which the flap is positioned away from the window opening.

17. A child carrier as set forth in claim 15 wherein said rib constitutes a first flexible resilient rib and wherein said cover support further comprises a second flexible resilient rib, said first and second ribs being adapted to extend generally along opposite side edge margins of the hood when the hood is in its covering position for supporting the hood over the child compartment.

18. A child carrier as set forth in claim 15 wherein said rib extends in arched configuration over the child compartment when the hood is in its covering position.

19. A child carrier as set forth in claim 17 wherein said cover support further comprises a third flexible resilient rib adapted to extend laterally with respect to the hood between the first and second ribs for further supporting the hood when the hood is in its covering position.

20. A canopy for use with a child carrier of the type for supporting a child adjacent the back of a hiker's torso, the child carrier comprising a forward portion, a rearward portion, a seat portion, and a child compartment, the forward portion of the carrier having straps engageable with the hiker's torso for enabling the hiker to tote the child carrier in a hands-free manner, the rearward portion of the child carrier being generally rearward of and spaced from the forward portion, the seat portion being generally between the forward and rearward portions of the child carrier and operatively connected thereto for supporting a child, the child compartment being between the forward and rearward portions and being defined at least in part by the seat portion, the canopy comprising:

a hood of flexible sheet material moveable between a covering position in which the hood extends generally from the rearward portion to the forward portion to cover the child compartment and an uncovering position in which the child compartment is exposed; and a cover support comprising at least one flexible resilient rib adapted to extend up from adjacent the rearward portion, over the child compartment and down to adjacent the forward portion when the hood is in its covering position for supporting the hood over the child compartment.

21. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a hood of flexible sheet material moveable between a covering position in which the hood extends generally from the rearward portion to the forward portion to cover the child compartment and an uncovering position in which the child compartment is exposed;

a cover support comprising first and second flexible resilient ribs adapted to extend generally along opposite side edge margins of the hood from adjacent the rearward portion to adjacent the forward portion when the hood is in its covering position for supporting the hood over the child compartment; and first and second sleeves at the opposite side edge margins of the hood for receiving the first and second ribs.

22. A child carrier as set forth in claim 21 wherein each of the first and second sleeves extends substantially the full length of the hood.

23. A child carrier as set forth in claim 21 wherein said first and second sleeves are each open at one end thereof for insertion of the ribs into and removal of the ribs from the sleeves.

24. A child carrier as set forth in claim 21 wherein said cover support further comprises a third flexible resilient rib, the hood further comprising a third sleeve extending laterally with respect to the hood between the first and second sleeves for receiving the third rib.

25. A child carrier as set forth in claim 21 wherein end portions of the first and second ribs extend into first and second rib-receiving pockets in the rearward portion of the carrier when the hood is in its covering position.

26. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a hood of flexible sheet material moveable between a covering position in which the hood extends generally from the rearward portion to the forward portion to cover the child compartment and an uncovering position in which the child compartment is exposed;

a cover support comprising first and second flexible resilient ribs adapted to extend generally along opposite side edge margins of the hood from adjacent the rearward portion to adjacent the forward portion when the hood is in its covering position for supporting the hood over the child compartment; and a hood-receiving pocket in the rearward portion of the carrier for receiving the hood to store it, the hood, when in its covering position, extending generally from the hood-receiving pocket to the forward portion of the carrier.

27. A child carrier for supporting a child adjacent the back of a hiker's torso comprising:

a forward portion having straps engageable with the hiker's torso for enabling the hiker to tote the child carrier in a hands-free manner;

a rearward portion generally rearward of and spaced from the forward portion;

a seat portion generally between the forward and rearward portions and operatively connected thereto for supporting a child;

a child compartment between the forward and rearward portions and defined at least in part by the seat portion;

a hood of flexible sheet material moveable between a covering position in which the hood extends generally from the rearward portion to the forward portion to cover the child compartment and an uncovering position in which the child compartment is exposed;

a cover support comprising first and second flexible resilient ribs adapted to extend generally along opposite side edge margins of the hood from adjacent the rearward portion to adjacent the forward portion when the hood is in its covering position for supporting the hood over the child compartment; and a window opening in the hood and a flexible mesh material in the window opening for protecting a child within the child compartment from exposure to sunlight while permitting air flow through the window opening.

28. A child carrier as set forth in claim 27 further comprising a generally transparent, water-impermeable, flexible flap on the hood swingable between a closed position in which the flap covers the window opening to prevent passage of rain water through the window opening and an open position in which the flap is positioned away from the window opening.

* * * * *

UNITED STATES PATENT AND TRADEMARK OFFICE

CERTIFICATE OF CORRECTION

PATENT NO. : 5,609,279

DATED : March 11, 1997

INVENTOR(S) : Timothy O'Shea

It is certified that error appears in the above-indentified patent and that said Letters Patent is hereby corrected as shown below:

Column 8, claim 11, line 17, "store its the hood," should read ---store it, the hood---.

Signed and Sealed this

Fifteenth Day of July, 1997

Bruce Lehman

*Attest:*

BRUCE LEHMAN

*Attesting Officer*

*Commissioner of Patents and Trademarks*